US011381913B2

(12) United States Patent
Forrester et al.

(10) Patent No.: US 11,381,913 B2
(45) Date of Patent: Jul. 5, 2022

(54) DYNAMIC DEVICE SPEAKER TUNING FOR ECHO CONTROL

(71) Applicant: Microsoft Technology Licensing, LLC, Redmond, WA (US)

(72) Inventors: Christopher Michael Forrester, Redmond, WA (US); Omar Joya, Seattle, WA (US); Bradley Robert Ekin, Marysville, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 115 days.

(21) Appl. No.: 16/841,606

(22) Filed: Apr. 6, 2020

(65) Prior Publication Data

US 2020/0322725 A1 Oct. 8, 2020

Related U.S. Application Data

(63) Continuation of application No. 16/375,794, filed on Apr. 4, 2019, now Pat. No. 10,652,654.

(51) Int. Cl.
*H04R 3/04* (2006.01)
*G10L 21/0232* (2013.01)
(Continued)

(52) U.S. Cl.
CPC ..... *H04R 3/04* (2013.01); *G10L 21/0232* (2013.01); *G10L 2021/02082* (2013.01); *G10L 2021/02163* (2013.01)

(58) Field of Classification Search
CPC . G10L 19/025; G10L 21/04; G10L 2015/223; G10L 2021/02082;
(Continued)

(56) References Cited

U.S. PATENT DOCUMENTS 10,200,800 B2 2/2019 Thomson
10,652,654 B1 * 5/2020 Forrester ..... H04R 3/04
(Continued)

FOREIGN PATENT DOCUMENTS

EP 3445069 * 2/2019 ..... H04S 7/00
EP 3445069 A1 2/2019

OTHER PUBLICATIONS

"International Search Report and Written Opinion Issued in PCT Application No. PCT/US2020/019567", dated Apr. 17, 2020, 15 Pages.
(Continued)

*Primary Examiner* — Lun-See Lao

(57) ABSTRACT

Dynamic device speaker tuning for echo control includes detecting audio rendering from a speaker on a device; based at least on detecting the audio rendering, capturing, with a microphone on the device, an echo of the rendered audio; performing a Fourier Transform on the echo and the rendered audio; determining a real-time transfer function for at least one signature band; determining a difference between the real-time transfer function and a reference transfer function; and tuning the speaker for audio rendering, based
(Continued)

at least on the difference between the real-time transfer function and the reference transfer function, by adjusting an audio amplifier equalization. For some examples, the signature band represents a wall echo or an alternative mounting option. For some examples, the echo is collected during intervals while the audio rendering is ongoing.

20 Claims, 15 Drawing Sheets

(51) Int. Cl.
*G10L 21/0208* (2013.01)
*G10L 21/0216* (2013.01)

(58) Field of Classification Search
CPC ..... G10L 2021/02163; G10L 21/0208; G10L 15/20; G10L 15/22; G10L 2021/02161; G10L 21/0232; G10L 21/0264; G10L 25/84; G10L 21/0364; G10L 21/06; H04L 2012/5612; H04L 2012/5615; H04L 2012/5616; H04L 2012/5618; H04L 2012/563; H04L 49/102; H04L 49/254; H04L 49/30; H04L 49/3009; H04L 49/3081; H04L 49/309; H04L 49/40; H04L 49/405; H04L 49/501; H04Q 11/0478; H04R 3/04; H04S 7/301; H04S 7/305; H04B 3/23; H04M 9/082
USPC ..... 381/94.1–94.5, 92, 61, 56–59; 700/94
See application file for complete search history.

(56) References Cited

U.S. PATENT DOCUMENTS

| | | | | |
|---|---|---|---|---|
| 2006/0153404 | A1 | 7/2006 | Gardner | |
| 2007/0078650 | A1* | 4/2007 | Rogers | G10L 21/04 704/229 |
| 2010/0137025 | A1* | 6/2010 | Tal | H04B 3/32 455/73 |
| 2015/0263692 | A1* | 9/2015 | Bush | H03G 3/32 381/122 |
| 2016/0192104 | A1* | 6/2016 | Nackvi | H04S 7/305 381/303 |

OTHER PUBLICATIONS

Rocha, et al., "Adaptive Audio Equalization of Rooms Based on a Technique of Transparent Insertion of Acoustic Probe Signals", In 120th Convention of Audio Engineering Society, May 20, 2006, 18 Pages.

* cited by examiner

DYNAMIC DEVICE SPEAKER TUNING FOR ECHO CONTROL

BACKGROUND

When speakers are placed near certain objects, such as walls, the resulting sound field may increase the echo path strength from the device speakers to the device microphones. For example, a speaker nearby a wall may produce a sound with increased bass (low frequency) level due to the wall acting as a speaker baffle. This increased echo strength may negatively affect conferencing/call quality for remote users if the echo becomes too intense for acoustic echo cancellation/suppression to be effective. Unfortunately, if the device's speaker amplifiers are permanently tuned to produce a high quality sound field in an open area surrounding the device, conferencing/call quality may suffer when the device is placed near objects that may intensify the echo path. Consequently, audio quality for both remote parties as well as device users depends on where a user places a device and how it is mounted within an environment.

SUMMARY

The disclosed examples are described in detail below with reference to the accompanying drawing figures listed below. The following summary is provided to illustrate some examples disclosed herein. It is not meant, however, to limit all examples to any particular configuration or sequence of operations.

Some aspects disclosed herein are directed to a system for dynamic device speaker tuning for echo control comprising: a speaker located on a device; a microphone located on the device; a processor; and a computer-readable medium storing instructions that are operative when executed by the processor to: detect audio rendering from the speaker; based at least on detecting the audio rendering, capture, with the microphone, an echo of the rendered audio; perform a Fourier Transform (FT) on the echo and perform an FT on the rendered audio; determine, based at least on the FT of the echo and the FT of the rendered audio, a real-time transfer function, wherein the real-time transfer function includes at least one signature band; determine a difference between the real-time transfer function and a reference transfer function; and tune the speaker for audio rendering, based at least on the difference between the real-time transfer function and the reference transfer function, by adjusting an audio amplifier equalization.

BRIEF DESCRIPTION OF THE DRAWINGS

The disclosed examples are described in detail below with reference to the accompanying drawing figures listed below.

Corresponding reference characters indicate corresponding parts throughout the drawings.

DETAILED DESCRIPTION

Figure 1:
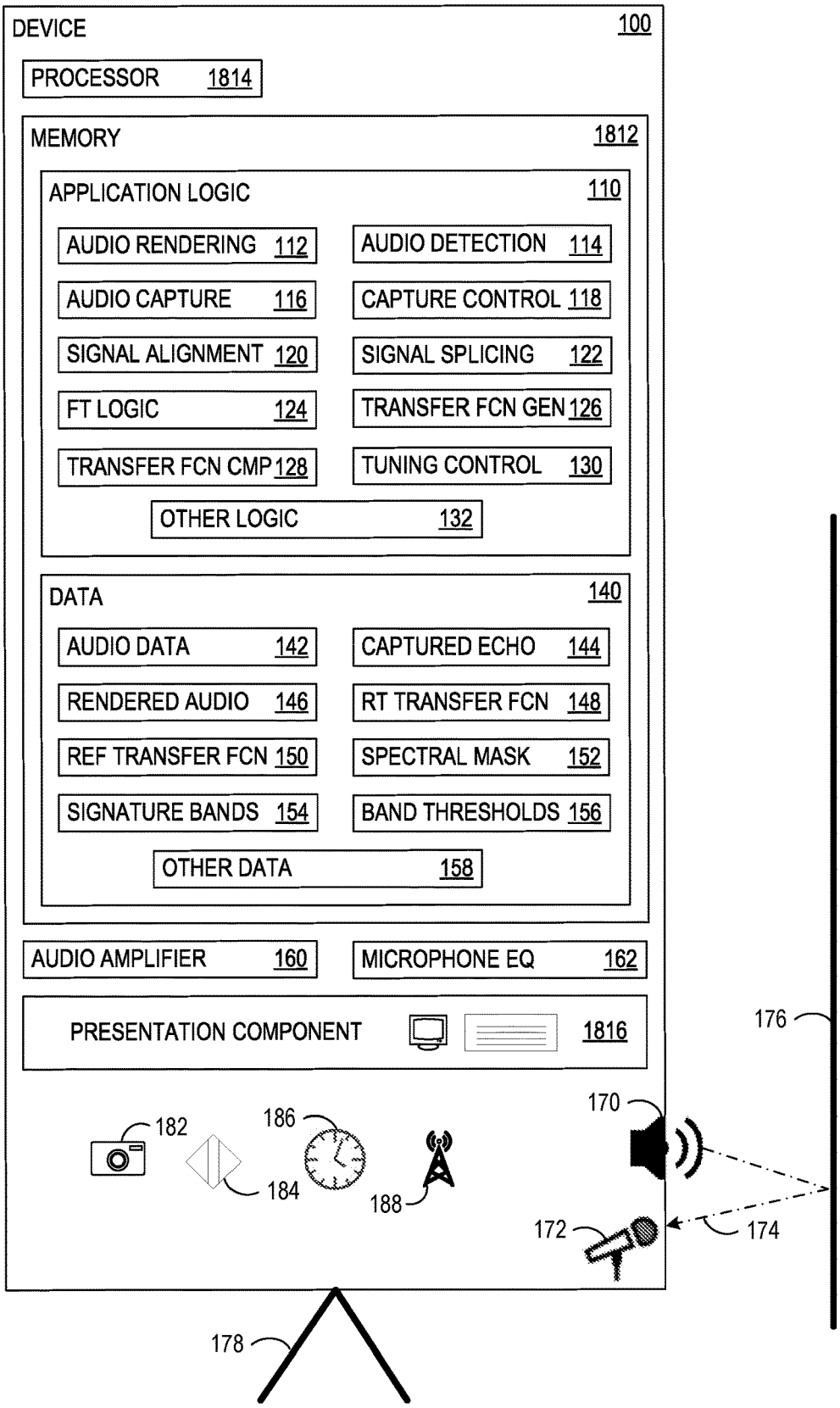
FIG. 1 illustrates a device that can advantageously employ dynamic device speaker tuning for echo control.

The various examples will be described in detail with reference to the accompanying drawings. Wherever possible, the same reference numbers will be used throughout the drawings to refer to the same or like parts. References made throughout this disclosure relating to specific examples and implementations are provided solely for illustrative purposes but, unless indicated to the contrary, are not meant to limit all examples.

In a communications device, which has microphones mounted in the device for local voice pick up, the microphones also pick up the speaker signal during a call. This speaker-to-microphone signal can sometimes be heard as an echo by the remote person, even if not heard locally by the device's user. Various devices have acoustic echo cancellation/suppression, but it loses effectiveness if overwhelmed by an overly-strong echo. Since echoes often have dominant frequency components, reducing the speaker output at the dominant echo frequencies can help preserve echo cancellation effectiveness. When speakers are placed near certain objects, such as walls, the resulting sound field may increase this echo path, which in turn may negatively affect the sound quality for a remote party during conferencing in the form of echo bursts/leaks of their own voice. For example, a speaker nearby a wall may produce a sound with an increased bass (low frequency) level, due to the wall acting as a speaker baffle. This in turn may increase the echo path and may make the audio sound less than optimal for remote parties. Unfortunately, if the device's speaker amplifiers are permanently tuned to negate the effects of an anticipated echo, so that the audio sounds pleasing to a remote party when the device is placed near a structure which increases the echo path level, then the device may produce a less-than ideal quality sound field for users surrounding the device when it is placed in an open area, such as on a cart, far away from any reflective objects. Consequently, audio quality for both users surrounding the device as well as remote parties may depend on where a user places the device and how it is mounted.

Therefore, the disclosure is directed to a system for dynamic device speaker tuning for echo control comprising: a speaker located on a device; a microphone located on the device; a processor; and a computer-readable medium storing instructions that are operative when executed by the processor to: detect audio rendering from the speaker; based at least on detecting the audio rendering, capture, with the microphone, an echo of the rendered audio; perform a Fourier Transform (FT) on the echo and perform an FT on the rendered audio; determine, based at least on the FT of the echo and the FT of the rendered audio, a real-time transfer function, wherein the real-time transfer function includes at least one signature band; determine a difference between the real-time transfer function and a reference transfer function; and tune the speaker for audio rendering, based at least on the difference between the real-time transfer function and the reference transfer function, by adjusting an audio amplifier equalization.

FIG. 1 illustrates a device 100 that can advantageously employ dynamic device speaker tuning for echo control. In some examples, device 100 is a version of computing device 1800, which is described in more detail in relation to FIG. 18. Device 100 has a processor 1814, a memory 1812, and a presentation component 1816, which are described in more detail in relation to computing device 1800 (of FIG. 18). Device 100 includes a speaker 170 located on device 100 and a microphone 172, also located on device 100. Some examples of device 100 have multiple speakers 170 for stereo or other enhanced audio, for example separate bass and higher (mid-range and treble) speakers. Some examples of device 100 have multiple microphones 172 for stereo audio or noise cancellation. In such systems, the processes described herein can be applied to each audio channel. With multiple speakers and microphones, audio beamforming can be advantageously employed, in some examples. Microphone 172 and speaker 170 can be considered to be part of presentation component 1816.

As illustrated, an echo path 174 returns audio rendered from speaker 170 to microphone 172 after reflecting from a wall 176. When device is moved away from wall 176, another echo path may exist due to mount 178 and/or other nearby objects. Some examples of device 100 are mounted to a wall, whereas other examples are mounted on a transportable cart, and others are placed on a table. Some examples of device 100 are moved among various positions. Some examples of device 100 include video screens in excess of 50 inches, with audio capability. Therefore, the speaker tuning described herein is able to compensate for the different sound environments dynamically. In some examples, the dynamic tuning extends beyond audio quality, and also reduces acoustic echo and noise. In some examples, the dynamic tuning is optimized for speech, although in some examples the dynamic tuning may be selectively controlled to be optimized for speech or music.

Memory 1812 holds application logic 110 and data 140 which contain components (instructions and data) that perform operations described herein. An audio rendering component 112 renders audio from audio data 142 over speaker 170 using audio amplifier 160. The audio can include music, a voice conversation (e.g., a conference telephone call routed over a wireless component 188), or an audio soundtrack stored in audio data 142. A copy of the rendered audio is stored in data 140 as rendered audio 146. Some examples of audio amplifier 160 support parametric equalization or some other means of adjusting specific frequency bands, including bandpass filtering. Some examples of audio amplifier 160 support audio compression. An audio detection component 114 detects audio rendering from speaker 170 that is picked up by microphone 172, and passes through microphone equalizer 162. Some examples of microphone equalizer 162 support audio compression. Based at least on detecting the audio rendering, an audio capture component 116 captures, with microphone 172, an echo of the rendered audio. A copy of the captured echo is stored in data 140 as captured echo 144.

Figure 7:
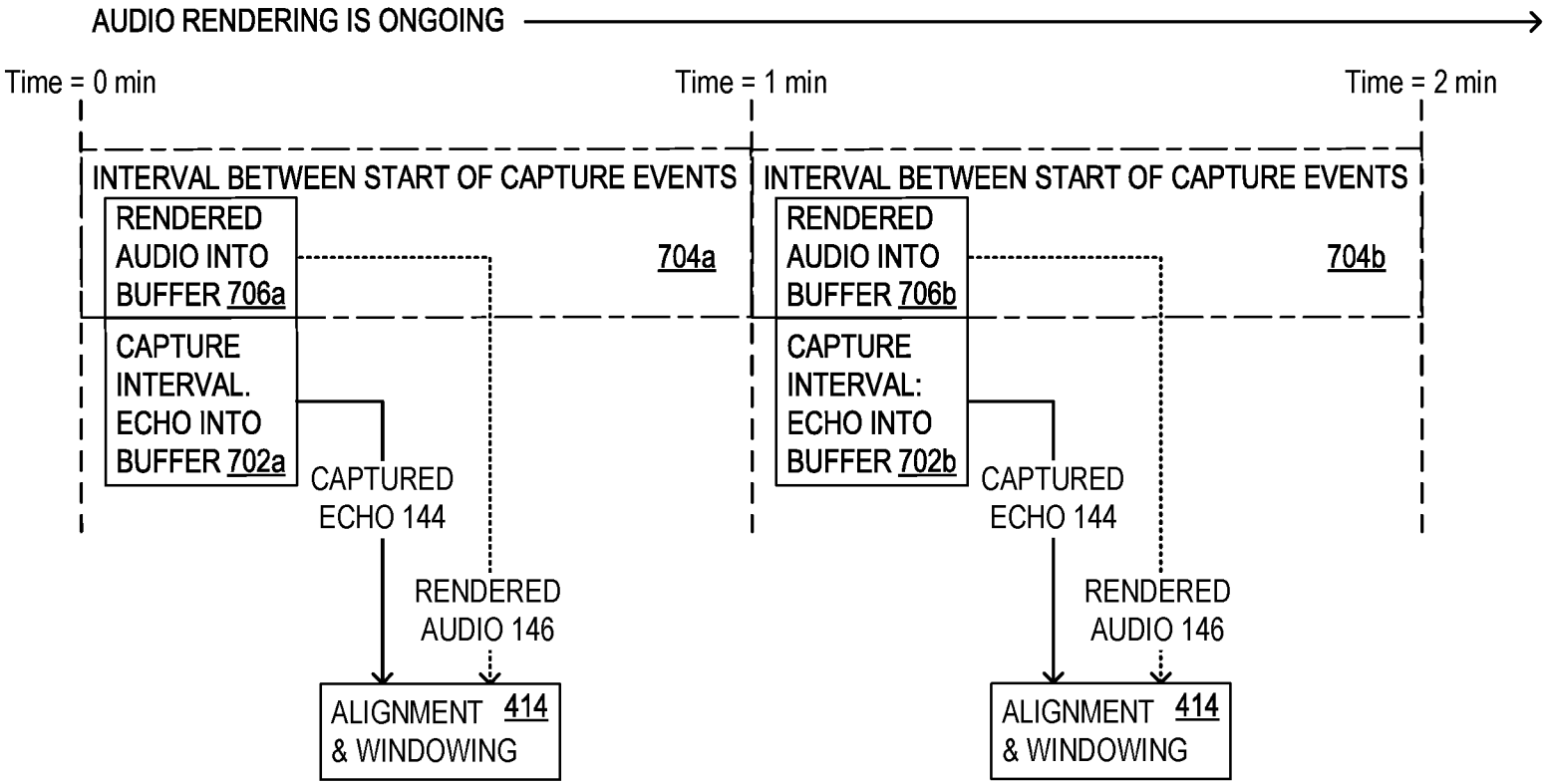
FIG. 7 shows an exemplary timeline of activities involved in dynamic device speaker tuning for echo control.

A capture control 118 controls audio capture component 116, for example with a timer 186. In some examples, capturing the echo comprises capturing the echo during a first time interval within a second time interval, the second time interval is longer than the first time interval; and repeating the capturing at the completion of each second interval while the audio rendering is ongoing (as shown in FIG. 7). In some examples, user input through presentation component 1816 triggers audio capture. In some examples, one or more of sensors 182 and 184 indicate that device 100 has moved, and this triggers audio capture. Sensor 182 is illustrated as an optical sensor, but it should be understood that other types of sensors, such as proximity sensors, can also be used. Additional aspects regarding the operation of capture control 118 are described in more detail with respect to FIG. 7.

A signal component 120 aligns captured echo 144 with rendered audio 146 when necessary, to obtain a better synchronized frequency response between the two signals. A signal windowing component windows segments of captured echo 144 and also windows segments of rendered audio 146. An FT logic component 124 performs an FT on captured echo 144 and also performs an FT on rendered audio 146. In some examples, the FTs are Fast Fourier Transforms (FFT). In some examples, FT logic component 124 is implemented on a digital signal processing (DSP) component. Additional descriptions of signal alignment, signal windowing, and FT operations are described in FIG. 6 and later figures. In some examples, captured echo 144 can include local voice pick-up. In some examples, captured echo 144 can include local noise from the environment. In such examples, an energy calculation such as a coherence calculation can determine whether captured audio comprises mostly or an echo rendered from speaker 170. A coherence calculation compares the power spectrum of captured echo 144 with rendered audio 146 to determine whether the power transfer between the signals meets a threshold. A transfer function generator 126 determines, based at least on the FT of captured echo 144 and the FT of rendered audio 146, a real-time transfer function 148 and stores it in data 140. In some examples, determining real-time transfer function 148 comprises dividing a magnitude of the FT of captured echo 144 by the FT of rendered audio 146.

Real-time transfer function 148 is compared with a reference transfer function 150 by a transfer function comparison component 128. In some examples, a spectral mask 152 is applied to real-time transfer function 148 and reference transfer function 150 for the comparison, to isolate particular bands of interest. In some examples, spectral mask 152 includes at least one signature band identified in signature bands data 154. A signature band is a portion (a band) in the audio spectrum that is particularly affected by a particular environmental factor. In some examples, the signature band comprises a signature band for a wall echo, which is approximately 300 Hertz (Hz). In some examples, the signature band comprises a signature band for a mount echo (e.g., an echo from mount 178). Transfer function comparison component 128 determines a difference between real-time transfer function 148 and reference transfer function 150. In some examples, band thresholds 156 are used to determine whether any tuning will occur within a particular band. For example, if the difference is below the threshold for a band, there will not be any tuning changes in that particular band. Thus, in some examples, transfer function comparison component 128 is further operative to determine whether the difference between real-time transfer function 148 and reference transfer function 150, within a first band, exceeds a threshold. In such examples, tuning speaker 170 for audio rendering comprises tuning speaker 170 for audio rendering within the first band, based at least on the difference between real-time transfer function 148 and reference transfer function 150 exceeding the threshold. In some examples, transfer function comparison component 128 is further operative to determine whether the difference between real-time transfer function 148 and reference transfer function 150, within a second band different from the first band, exceeds a threshold. In such examples, tuning speaker 170 for audio rendering comprises tuning speaker 170 for audio rendering within the second band, based at least on the difference between real-time transfer function 148 and reference transfer function 150 exceeding the threshold (for the second band).

When tuning is indicated by the output results of transfer function comparison component 128 a tuning control component tunes speaker 170 for audio rendering, based at least on the difference between real-time transfer function 148 and reference transfer function 150, by adjusting audio amplifier 160 equalization. Other logic 132 and other data 158 contain other logic and data necessary for performing the operations described herein. Some examples of other logic 132 contains an artificial intelligence (AI) or machine learning (ML) capability. A ML capability can be advantageously employed to recognize environmental factors, for example, using sensors 182 and 184 and tuning control histories, to refine equalization of audio amplifier 160. In some examples, a user control of equalization is also input into an ML capability to predict the desirable tuning parameters.

Figure 2:
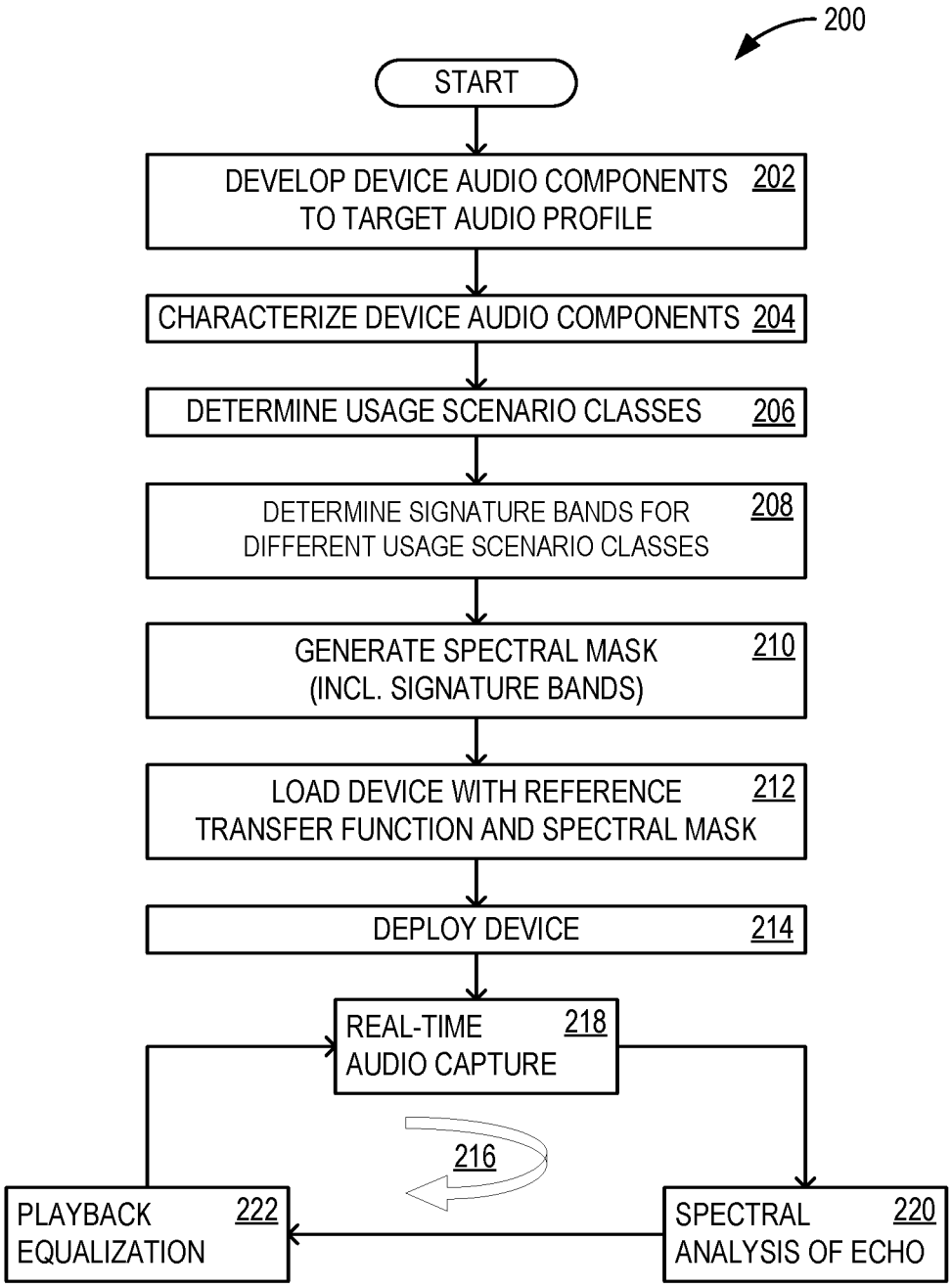
FIG. 2 is a flow chart illustrating exemplary operations involved in dynamic device speaker tuning for echo control.

FIG. 2 is a flow chart 200 illustrating exemplary operations of device 100 that are involved in dynamic device speaker tuning for echo control. Flow chart 200 begins in operation 202 with a sound engineer developing the audio components of device 100 to a target audio profile, so that device provides a pleasing sound in the proper environment. Operations 204 characterizes the audio components of device 100, and is described in more detail with respect to FIG. 3. Usage scenario classes are determined in operation 206, for example operation of device 100 near a wall on a particular mount 178. Signature bands for the different usage scenario classes are determined in operation 208 which can be loaded onto device 100 (e.g., in signature bands data 154). This permits device 100 to determine certain environmental conditions, for example, that device 100 is nearby a wall, by comparing echo spectral characteristics with signature bands data 154. Spectral mask 152 is generated in operation 210, using the signature bands. This permits tuning operations to have a more noticeable effect, by concentrating on bands that show more significant environmental dependence.

Reference transfer function 150 and spectral mask 152 are loaded onto device 100 in operation 212. Reference transfer function 150 described a target audio profile, because it is the result of audio engineer tuning in a favorable environment. Device 100 is deployed in operation 214, and an ongoing dynamic speaker tuning loop 216 commences whenever audio is being rendered by device 100. Loop 216 includes real-time audio capture in operation 218, spectral analysis of the captured echo 144 in 220, and playback equalization (of audio amplifier 160) in operation 222. Loop 216 then returns to operation 218 and continues while audio is rendered.

Figure 3:
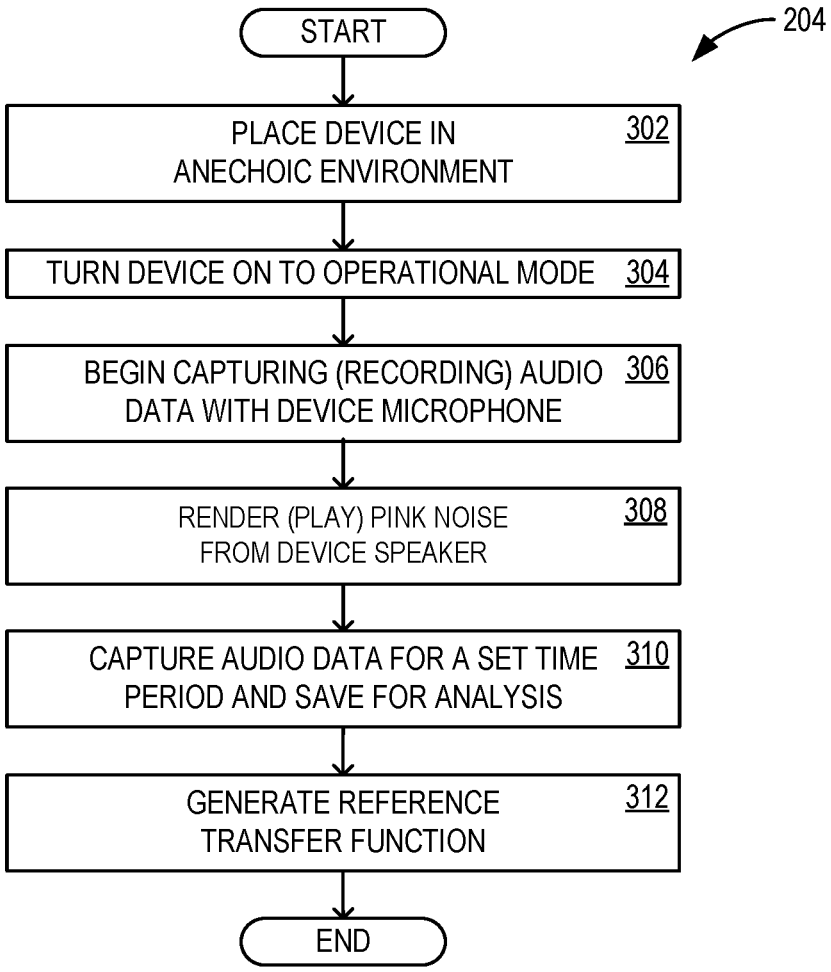
FIG. 3 is another flow chart illustrating exemplary operations involved in device characterization, in support of dynamic device speaker tuning for echo control.

FIG. 3 is a flow chart illustrating further detail for operation 204. Operation 204 commences after the audio engineer has ensured that device 100 is feature-complete and has all hardware and firmware validated. Apart from the loading of tuning profile data, device 100 should be in the state at which it will be deployed (e.g., delivered to a user). In operation 302, device 100 is placed in an anechoic environment where reverberation and reflections do not interfere with the echo path. Device 100 is turned on in operation 304 and operation 306 begins capturing (recording) audio, using microphone 172. In operation 308, pink noise is rendered (played through speaker 170). A certain length of time, for example, several seconds, of the pink noise picked up by microphone 172 is captured and saved in operation 310. Operation 312 then generates (calculates) reference transfer function 150, using the FT of the pink noise and the FT of the audio captured in operation 310. In some examples, a portion of the calculations are processed remotely, rather than entirely on device 100.

Figure 4:
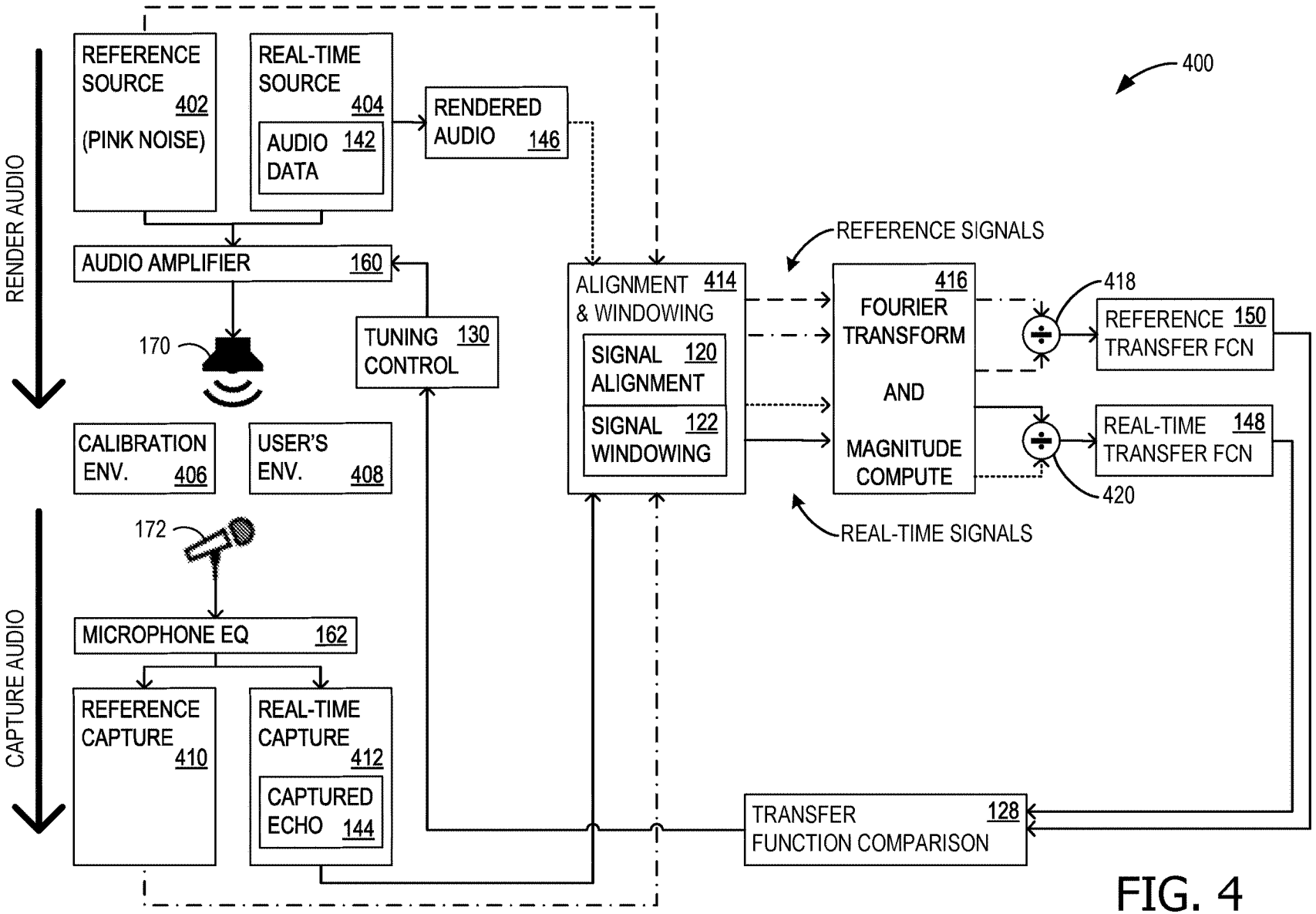
FIG. 4 is a block diagram of example components involved in dynamic device speaker tuning for echo control.

FIG. 4 is a block diagram 400 of example components involved in dynamic device speaker tuning for echo control for device 100. A reference source 402 provides white or pink noise, as described for FIG. 3 during device characterization. In some examples, reference source 402 is an external source or is a software component running on device 100. The calibration noise is supplied to audio amplifier 160 and rendered (played) by speaker 170. During device characterization, this occurs in a calibration-quality anechoic environment 406. The sound energy is captured by microphone 172, passed through microphone equalizer 162, and saved in a reference capture 410. Both reference source 402 and reference capture 410 each supplies its respective signal to an alignment and windowing component 414, which includes both signal alignment component 120 and signal windowing component 122. To assist with tracking the signal paths in FIG. 4, the signal from reference source 402 is shown as a dashed line and the signal from reference capture 410 is shown as a dash-dot line.

Alignment and windowing component 414 sends the aligned and windowed signals to a FT and magnitude computation component 416. The signals originating from reference source 402 and reference capture 410 are still traced as a dashed line and dash-dot line, respectively. FT and magnitude computation component 416 performs a Fourier transform and finds the magnitude for each signal and passes the signals to a comparator component 418 that performs a division of the magnitude of the FT of the reference capture 410 signal by the magnitude of the FT of the reference source 402 signal. This provides (generates or computes) reference transfer function 150, which is stored on device 100, as described above.

When device 100 is in the possession of an end user, dynamic speaker tuning can be advantageously employed, leveraging reference transfer function 150. With a similar signal path, a real-time source 404, for example playing audio data 142, supplies an audio signal to audio amplifier 160, which is then rendered by speaker 170. This occurs in a user's environment 408, which can be nearby wall 176, on mount 178, or some other environment that may be unfavorable for sound reproduction. The sound energy in the echo is captured by microphone 172, passed through microphone equalizer 162, and saved in a real-time capture 412 as captured echo 144. A copy of rendered audio 146 (from real-time source 404) is saved. Each of rendered audio 146 and captured echo 144 is supplied to alignment and windowing component 414. To assist with tracking the signal paths in FIG. 4, the signal from rendered audio 146 is shown as a dotted line and the signal from captured echo 144 is shown as a solid line.

Alignment and windowing component 414 sends the aligned and windowed signals to FT and magnitude computation component 416. The signals originating from rendered audio 146 and captured echo 144 are still traced as a dotted line and solid line, respectively. FT and magnitude computation component 416 performs a Fourier transform and finds the magnitude for each signal and passes the signals to a comparator component 420 that performs a division of the magnitude of the FT of captured echo 144 by the magnitude of the FT of rendered audio 146. This provides (generates or computes) real-time transfer function 148. Because the FT assumes periodic signals, windowing emulates a real-time signal as periodic and provides a good approximation of the frequency domain content. Real-time transfer function 148 and reference transfer function 150 are both provided to transfer function comparison component 128, which drives tuning control 130 to adjust audio amplifier 160 equalization. In some examples, a portion of the calculations are processed remotely, rather than entirely on device 100.

This technique provides a continuous closed loop (feedback loop) that adapts to the environment in which device 100 is placed. The four overarching stages are: (1) Device Characterization, (2) Data Capture, (3) Spectral Analysis, and (4) Equalization. The device characterization stage addresses the issue that the acoustic echo characteristics will be unique to devices form factors because of microphone and speaker locations. A desired echo frequency spectrum characterization is needed to serve as a reference for adaptive tuning. However, absent device form factor alterations, this is only needed once. During the data capture stage, device 100 periodically polls the echo coming from speaker 170 to microphone 170 (or from multiple speakers 170 to multiple microphones 170). This requires simultaneous capture and rendering of audio streams, which are common in voice over internet protocol (VOIP) calls. During the spectral analysis stage, a DSP component, whether through the cloud or imbedded in device 100, converts time domain audio data to the frequency domain. The DSP will compare the energy spectrum of the audio against the reference mask from the device characterization stage. During the equalization stage, deviations from a pre-determined frequency mask will be corrected by the DSP by applying filters to fit the captured audio closer to the mask.

Figure 5:
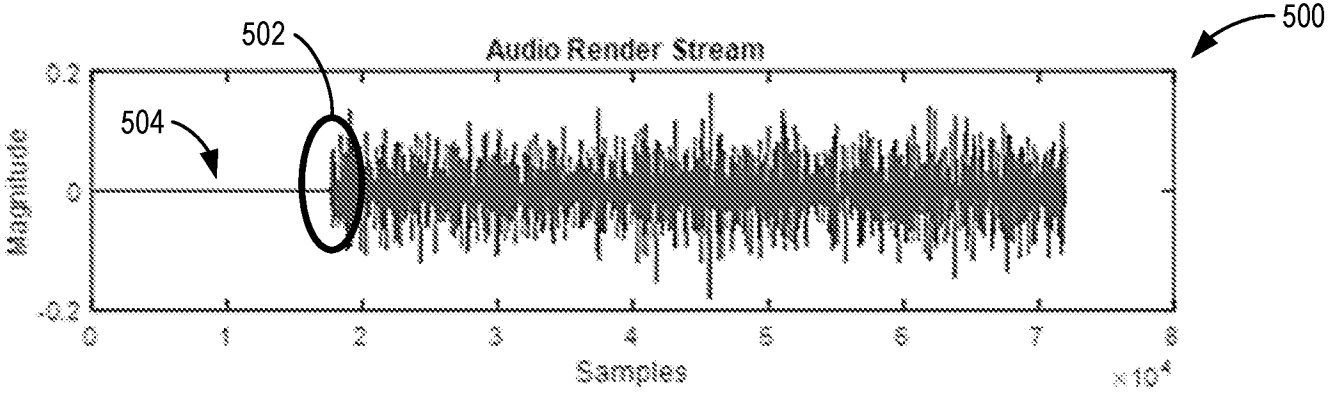
FIG. 5 shows an example audio render stream signal.
Figure 6:
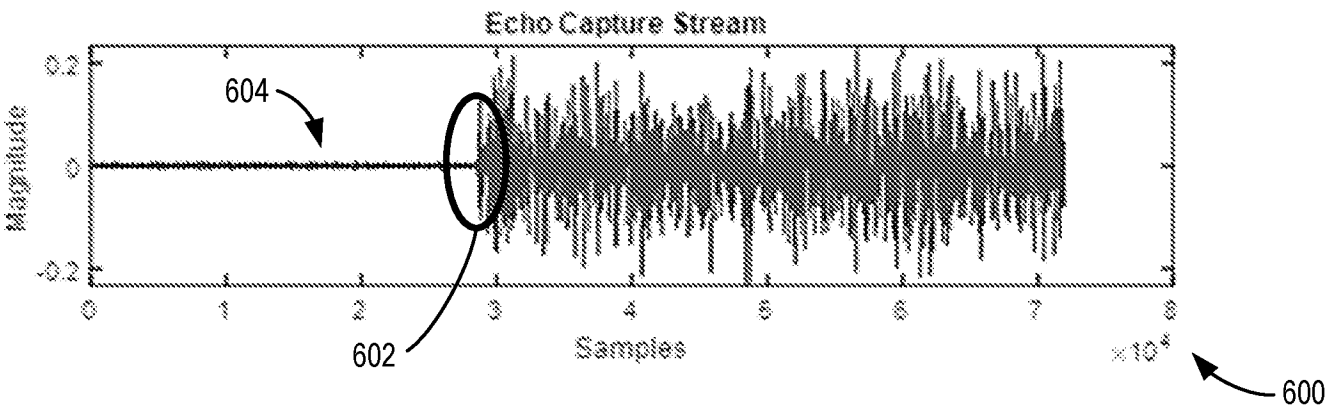
FIG. 6 shows an example captured echo stream for alignment with the signal of FIG. 5.

FIG. 5 shows an example rendered audio signal 500, with a starting point 502 prior to alignment with signal 600 of FIG. 6, which has a starting point 602. Starting points 502 and 602 are signals above any noise 504 and 604 that may be present. For alignment, signals 500 and 600 are shifted in time, relative to each other, so that starting points 502 and 602 coincide.

FIG. 7 shows an exemplary timeline 700 of activities involved in dynamic device speaker tuning, for example activities controlled by capture control 118 (of FIG. 1). In some examples, capturing the echo (e.g., captured echo 144) comprises capturing the echo during a first time interval 702*a* or 702*b* within a second time interval 704*a* or 704*b*, wherein the second time interval (704*a* or 704*b*) is longer than the first time interval (702*a* or 702*b*, respectively); and repeating the capturing at the completion of each second interval (704*a* or 704*b*) while the audio rendering is ongoing. Timer 186 (of FIG. 1) is used for timing the various intervals. As indicated, the rendered audio is stored (e.g., as rendered audio 146) during the time that captured echo 144 is stored. Each of rendered audio 146 and captured echo 144 is supplied to alignment and windowing component 414. For consistency with FIG. 4, the signal from rendered audio 146 is shown as a dotted line and the signal from captured echo 144 is shown as a solid line.

Figure 8:
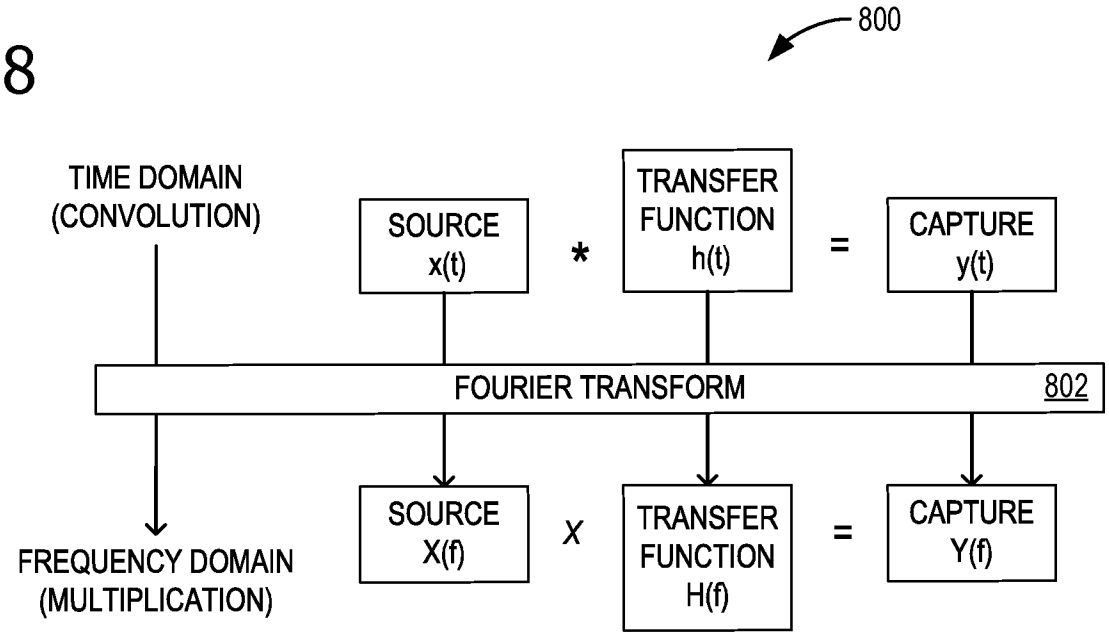
FIG. 8 is a block diagram explaining mathematical relationships relevant to reference spectrum capture, in support of dynamic device speaker tuning for echo control.
Figure 9:
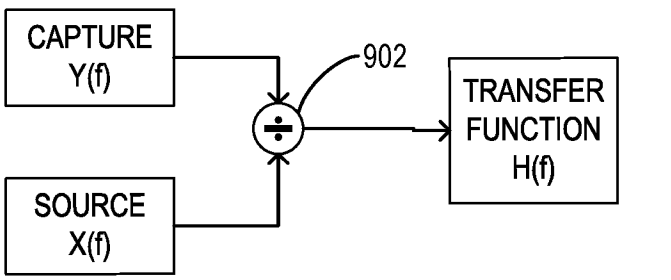
FIG. 9 shows a schematic representation of the block diagram of FIG. 8.

FIG. 8 is a block diagram 800 explaining mathematical relationships relevant to reference spectrum capture, and FIG. 9 shows a schematic representation 900 of block diagram 800. In time domain representation, a source x(t) convolved with a time domain transfer function h(t) gives the result (which here is the captured echo) capture y(t). However, applying a FT 802, in frequency domain representation, a source X(f) multiplied by a frequency domain transfer function H(f) gives capture Y(f). Therefore, a division operation 902, shown in schematic representation 900, generates (calculates) H(f) as capture Y(f) divided by source X(f). This is also shown in Eq. (1) and Eq. (2):

$$X(f)xH(f) = Y(f) \quad \text{Eq. (1)}$$

$$H(f) = \frac{Y(f)}{X(f)} \quad \text{Eq. (2)}$$

Figure 10:
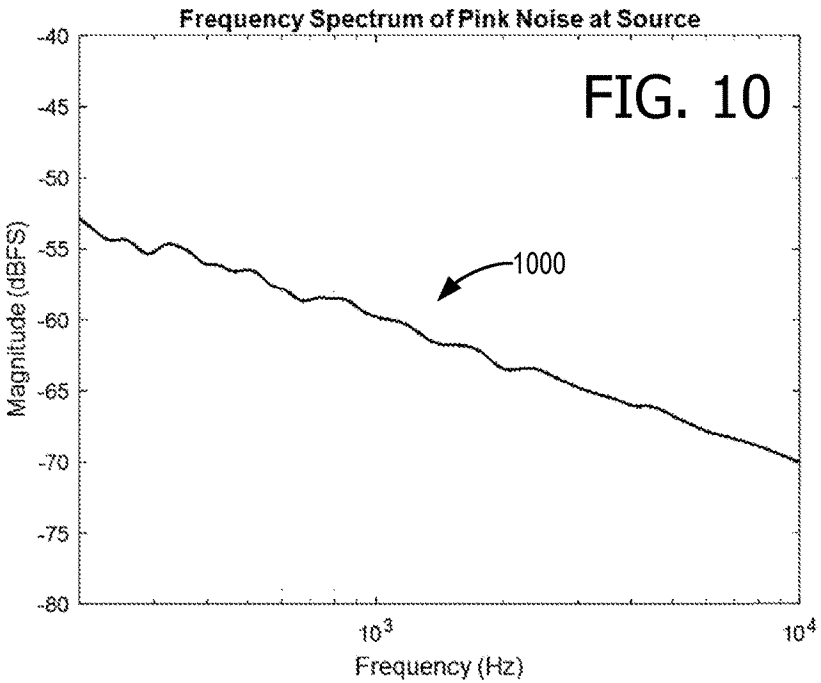
FIG. 10 shows an exemplary spectrum of rendered pink noise.
Figure 11:
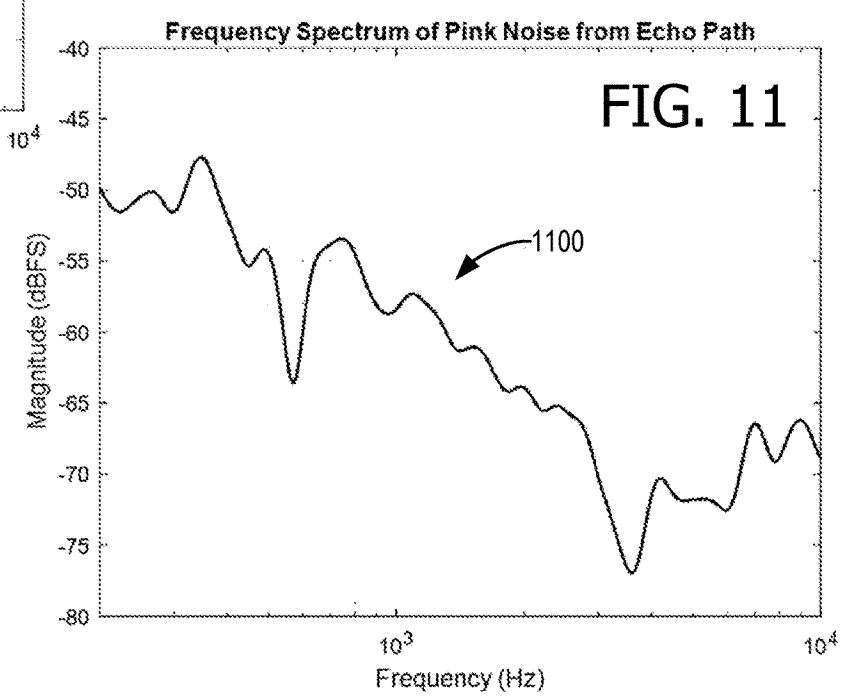
FIG. 11 shows an exemplary spectrum of a captured echo of the pink noise of FIG. 10.
Figure 12:
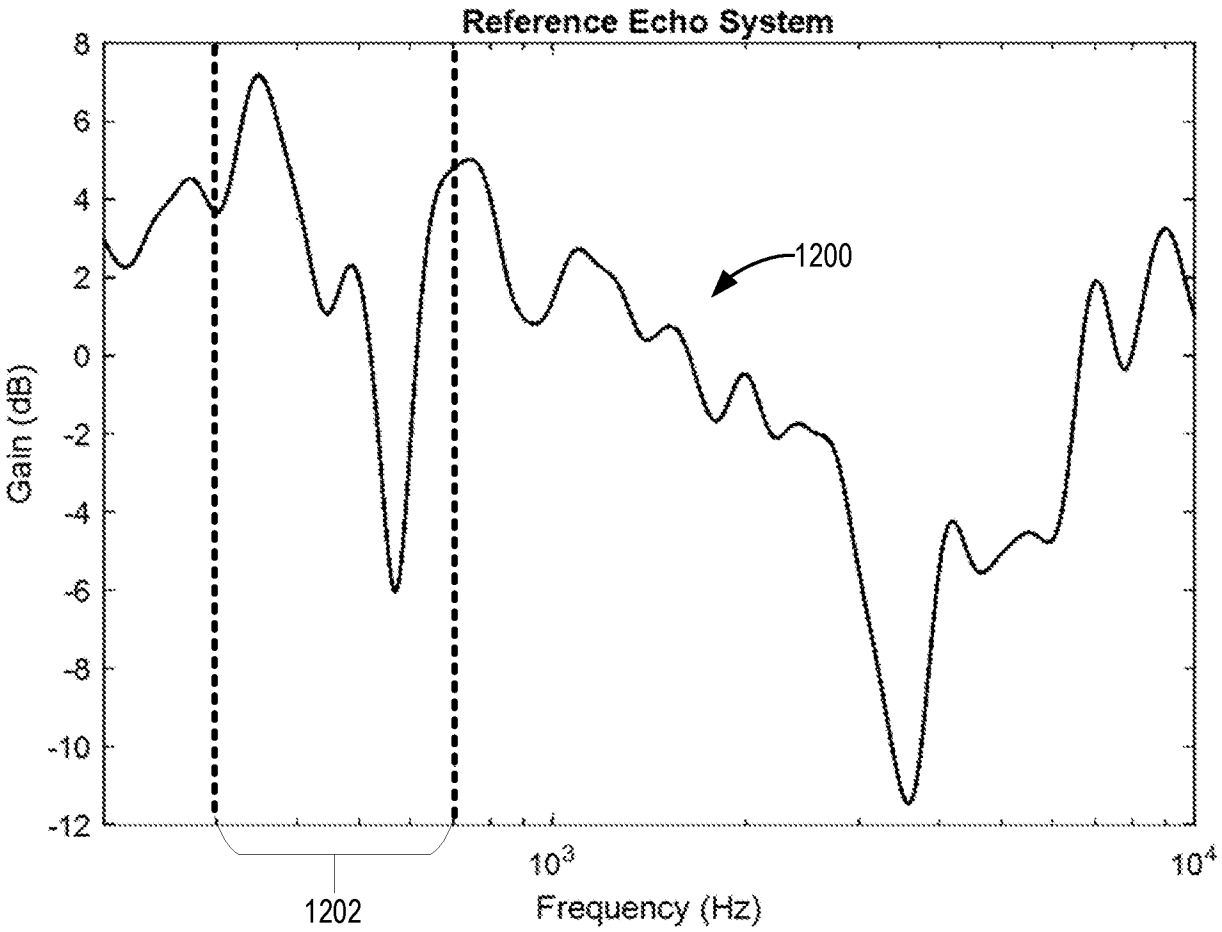
FIG. 12 shows the spectrum of a reference transfer function that relates the spectrums shown in FIGS. 10 and 11.

FIG. 10 shows an exemplary spectrum 1000 of rendered pink noise, and FIG. 11 shows an exemplary spectrum 1100 of a captured echo of the pink noise of FIG. 10. FIG. 12 shows the spectrum 1200 of the reference echo system (in this case, reference transfer function 150). A signature band 1202 is identified, which is where an increased spectral power response can be expected when device 100 is placed near wall 176. In some examples, a wall signature band ranges from approximately 200 Hz to approximately 600 Hz. Spectrum 1200 is calculated by dividing spectrum 1100 by spectrum 1000. Because the figures are scaled in decibels (dB), multiplication and division appear as addition and subtraction in the graphs.

Figure 13:
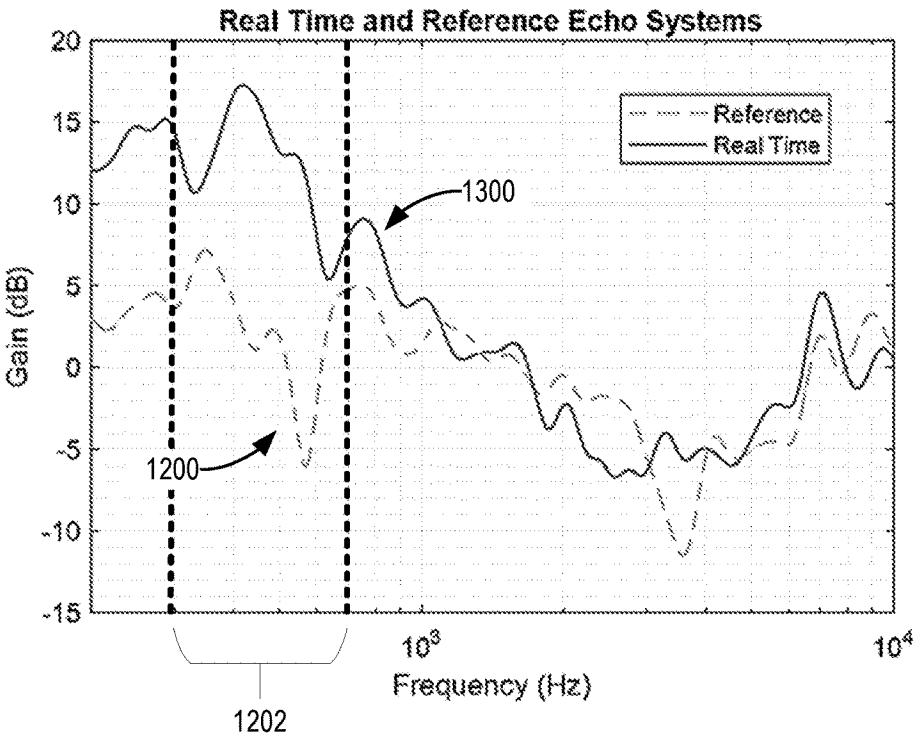
FIG. 13 shows a comparison between the spectrum for an exemplary real-time transfer function the spectrum 1200 of FIG. 12.
Figure 14:
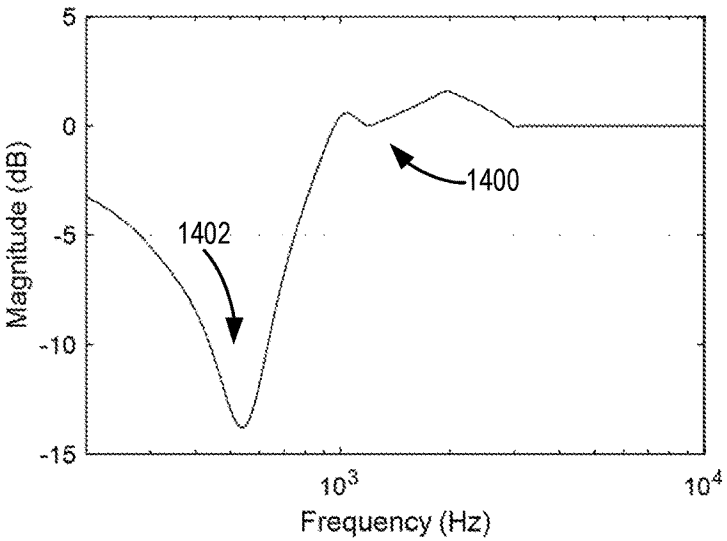
FIG. 14 shows an exemplary playback equalization spectrum to be applied for dynamic device speaker tuning.

FIG. 13 shows a comparison between the spectrum 1300 for an exemplary real-time transfer function (e.g., real-time transfer function 148) and spectrum 1200 for the reference echo system (e.g., reference transfer function 150). As can be seen, in FIG. 13, spectrum 1300 has heightened magnitude, relative to spectrum 1200, within signature band 1202. This indicates that device 100 is operating nearby a wall (e.g., wall 176). FIG. 14 shows the calculated playback equalization spectrum 1400 to be applied to 160 by tuning control 130. A reduction 1402 is evident in spectrum 1400, to help reduce the effect of excess bass, due to the proximity of a wall.

Figure 15:
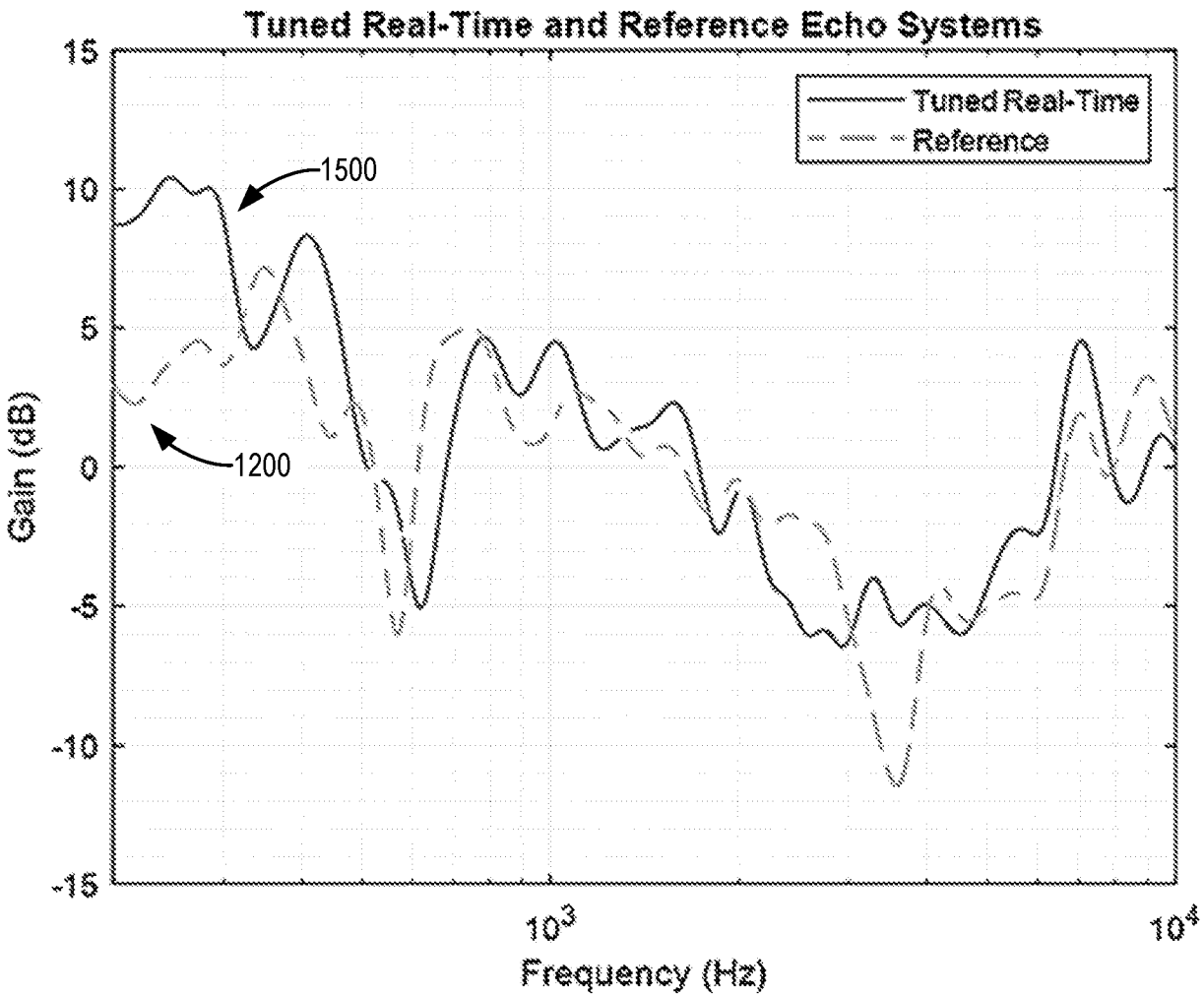
FIG. 15 shows an exemplary spectral representation of audio rendering after dynamic device speaker tuning has been advantageously employed.
Figure 16A:
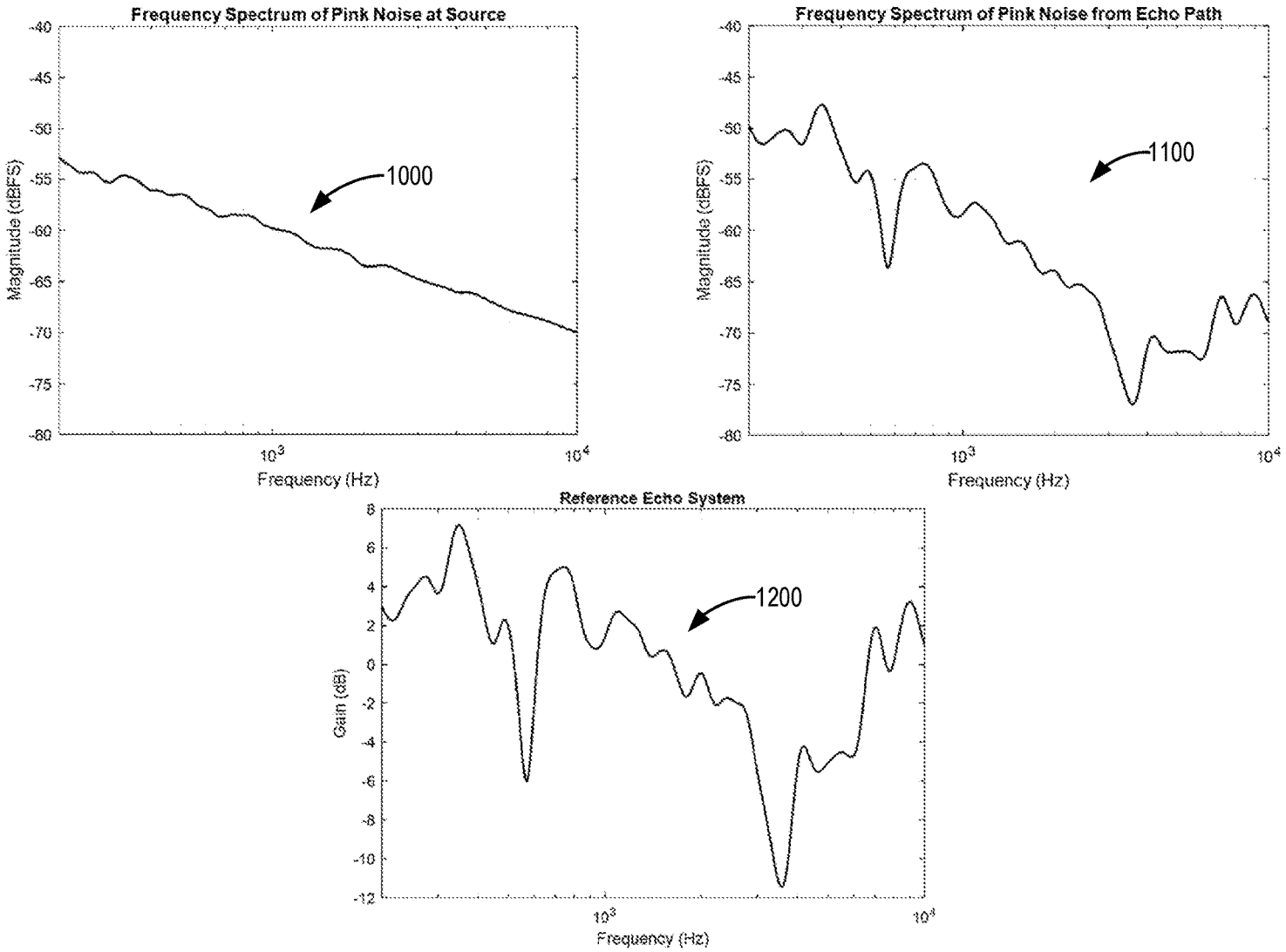
FIG. 16A is reproduction of some of the spectral plots of FIGS. 10-15, at reduced magnification for side-by-side viewing.
Figure 16B:
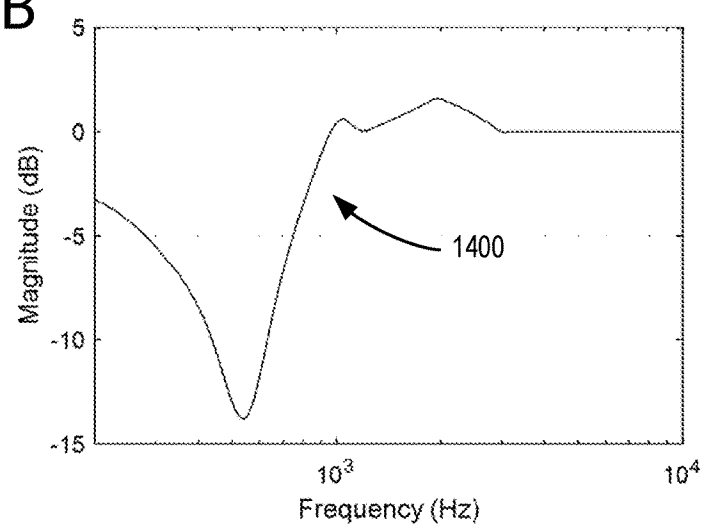
FIG. 16B is reproduction of some of the spectral plots of FIGS. 10-15, at reduced magnification for side-by-side viewing.
Figure 16B:
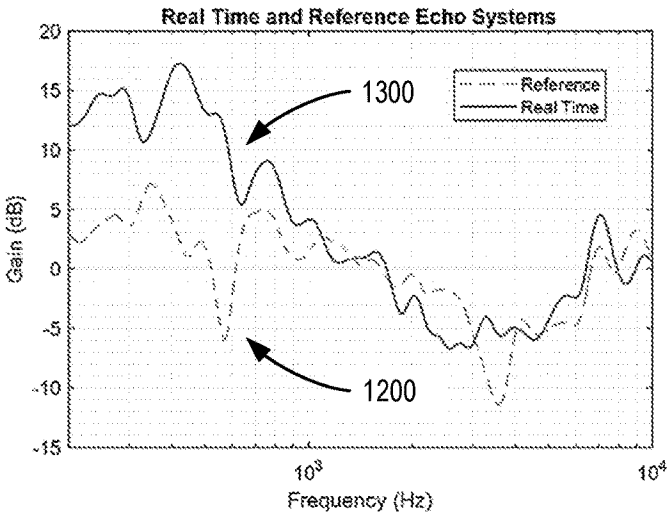
Figure 16B:
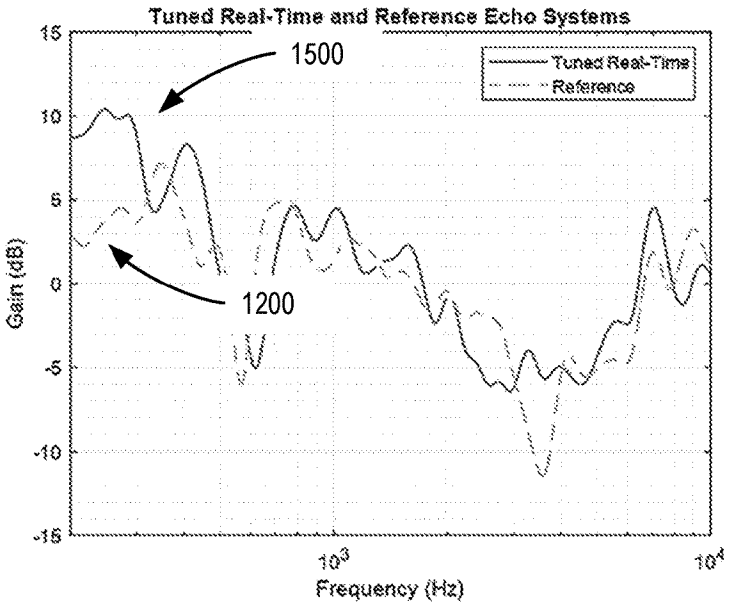

FIG. 15 shows an exemplary spectral representation of audio rendering after dynamic device speaker tuning has been advantageously employed. Rendered spectrum 1500, although not perfect, is still fairly close to spectrum 1200, and manifests less of an effect of a wall echo. FIG. 16A is reproduction of spectra 1000, 1100, and 1200, and FIG. 16B is reproduction of spectra 1300, 1400, and 1500, plotted in FIGS. 10-15, at reduced magnification for side-by-side viewing. Although the processes described above compare the energy of signals (e.g., rendered and echo audio signals, such as within a particular band), it should be noted that alternative methods exist to compare the energy of signals based on where device 100 is placed. In some examples, time-domain energy analysis is used to determine signal energy remaining after bandpass filtering. In such examples, the pass band is centered on the frequency of interest in a signature band that is based on device characteristics and certain echo scenarios (e.g., a wall echo). Both the rendered and captured echo signals are subjected to bandpass filtering and energy detection, and the ratio of the signal energy can then be used to ascertain the presence of a significant echo.

Figure 17:
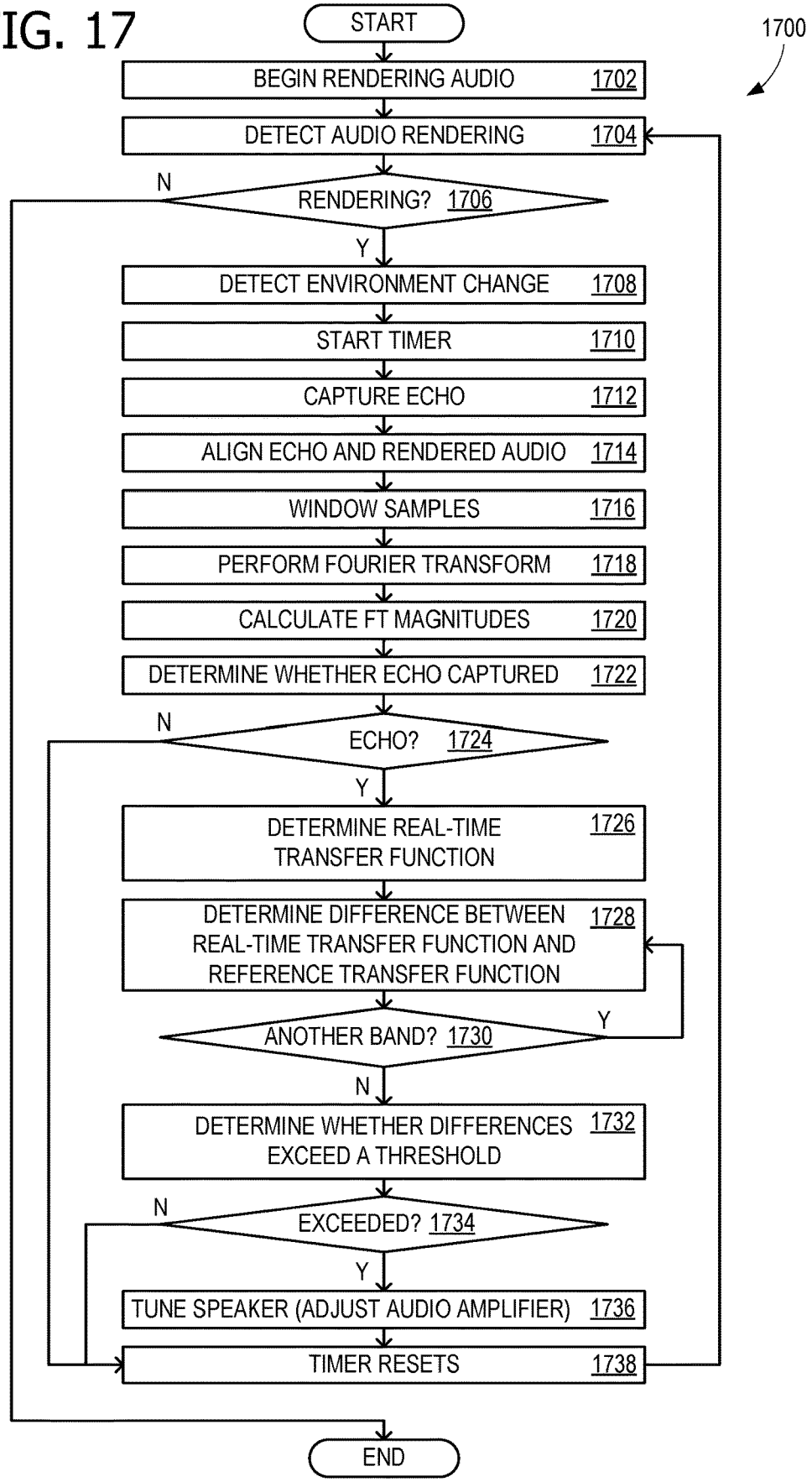
FIG. 17 is another flow chart illustrating exemplary operations involved in dynamic device speaker tuning.

FIG. 17 is a flow chart 1700 illustrating exemplary operations involved in dynamic device speaker tuning. In some examples, operations described for flow chart 1700 are performed by computing device 1800 of FIG. 18. Flow chart 1700 commences in operation 1702 with the user rendering an audio stream, for example by starting a VOIP call or playing music on the device. Operation 1704 includes detecting audio rendering from a speaker on the device. Decision operation 1706 either continues the adaptive tuning algorithm described herein or ends tuning activities when the rendering is completed. Operation 1708 detects an environment change with sensors, such as an accelerometer sensing movement.

A timer is started in operation 1710, to determine when audio capture events will begin and end. The timer determines how often the algorithm will begin recording loopback audio and captured audio and how often the playback tuning is adjusted. Operation 1712 includes, based at least on detecting the audio rendering, capturing, with a microphone on the device, an echo of the rendered audio. The captured echo is saved in a buffer in memory. In some examples, capturing the echo comprises capturing the echo during a first time interval within a second time interval, the second time interval is longer than the first time interval; and repeating the capturing at the completion of each second interval while the audio rendering is ongoing. Operation 1714 includes aligning the echo with a copy of the rendered audio. Because captured audio goes through processing and transit time to and from a reflection surface, it will be delayed relative to the loopback that is captured straight from the source. Signal alignment is applied to the two signals, often using cross-correlation techniques, so that they are in sync with each other sample-by-sample. Audio samples are windowed, if necessary, in operation 1716. Generally, windowing is recommended to calculate an accurate FT, for example to avoid spectral leakage.

Operation 1718 includes performing an FT on the echo and performing an FT on the rendered audio. The two signals are now in the frequency-domain. In some examples, the FT comprises an FFT. Operation 1720 calculates the calculate FT magnitudes to provide the frequency responses. Operation 1722 determines whether the captured audio contains mostly noise, or instead whether a significant portion of captured audio is from the audio that had been rendered from the speaker. That is, operation 1722 includes determining whether a portion, above a threshold, of captured audio comprises an echo of the rendered audio. If the captured audio contains mostly noise, as determined in decision operation 1724, then audio tuning may not be required at this point. However, if the captured audio contains an echo of the rendered audio, then operation 1726 includes determining, based at least on the FT of the echo and the FT of the rendered audio, a real-time transfer function, wherein the real-time transfer function includes at least one signature band. In some examples, determining the real-time transfer function comprises dividing a magnitude of the FT of the echo by the FT of the rendered audio. In some examples, the signature band comprises a signature band for a wall echo. In some examples, the signature band comprises a signature band for a mount echo. Operation 1728 then includes determining a difference between the real-time transfer function and a reference transfer function. To accomplish this, the frequency response of the captured signal is divided by the frequency response of the source signal. This is the real-time transfer function.

In some examples, differences are determined by the energy within in a signature band, for example a 200 Hz to 400 Hz or 600 Hz band, or some other band. The energy change in this signature band is compared to the ideal energy change for that same band in the reference transfer function. The comparison of the energy between the real-time and reference transfer functions determines how the amplifier equalization is adjusted. If the real-time energy is higher, the equalization is adjusted to bring this down to match closer with the reference energy. This process is dependent on the equalization architecture and how easily it can be adjusted. Some equalizers are parametric, which simplifies adjusting gains in specific frequency bands. Decision operation 1730 determines whether another band is to be checked for a difference, and operation 1728 is repeated, if necessary.

Operation 1732 includes determining whether the difference between the real-time transfer function and the reference transfer function, within a first band, exceeds a threshold; and tuning the speaker for audio rendering comprises tuning the speaker for audio rendering within the first band, based at least on the difference between the real-time transfer function and the reference transfer function exceeding the threshold. If more than one band is used for determining transfer function differences, operation 1732 repeats for the additional bands. Some examples of operation 1732 include determining whether the difference between the real-time transfer function and the reference transfer function, within a second band different from the first band, exceeds a threshold; and tuning the speaker for audio rendering comprises tuning the speaker for audio rendering within the second band, based at least on the difference between the real-time transfer function and the reference transfer function exceeding the threshold. If the differences are below a threshold (e.g., the transfer responses are similar enough), as determined in decision operation 1734, or are no longer changing tuning is complete.

If tuning is needed, then operation 1736 includes tuning the speaker for audio rendering, based at least on the difference between the real-time transfer function and the reference transfer function, by adjusting an audio amplifier equalization. The timer resets in operation 1738, and flow chart 1700 returns to operation 1704 to ascertain whether the speakers are still rendering audio.

Additional Examples

Some aspects and examples disclosed herein are directed to a system for dynamic device speaker tuning for echo control comprising: a speaker located on a device; a microphone located on the device; a processor; and a computer-readable medium storing instructions that are operative when executed by the processor to: detect audio rendering from the speaker; based at least on detecting the audio rendering, capture, with the microphone, an echo of the rendered audio; perform an FT on the echo and perform an FT on the rendered audio; determine, based at least on the FT of the echo and the FT of the rendered audio, a real-time transfer function, wherein the real-time transfer function includes at least one signature band; determine a difference between the real-time transfer function and a reference transfer function; and tune the speaker for audio rendering, based at least on the difference between the real-time transfer function and the reference transfer function, by adjusting an audio amplifier equalization.

Additional aspects and examples disclosed herein are directed to a method of dynamic device speaker tuning for echo control comprising: detecting audio rendering from a speaker on a device; based at least on detecting the audio rendering, capturing, with a microphone on the device, an echo of the rendered audio; performing an FT on the echo and performing an FT on the rendered audio; determining, based at least on the FT of the echo and the FT of the rendered audio, a real-time transfer function, wherein the real-time transfer function includes at least one signature band; determining a difference between the real-time transfer function and a reference transfer function; and tuning the speaker for audio rendering, based at least on the difference between the real-time transfer function and the reference transfer function, by adjusting an audio amplifier equalization.

Additional aspects and examples disclosed herein are directed to one or more computer storage devices having computer-executable instructions stored thereon for dynamic device speaker tuning for echo control, which, on execution by a computer, cause the computer to perform operations comprising: detecting audio rendering from a speaker on a device; based at least on detecting the audio rendering, capturing, with a microphone on the device, an echo of the rendered audio, wherein capturing the echo comprises capturing the echo during a first time interval within a second time interval, wherein the second time interval is longer than the first time interval; and repeating the capturing at completion of each second interval while the audio rendering is ongoing; aligning the echo with a copy of the rendered audio; performing an FT on the echo and performing an FT on the rendered audio; determining, based at least on the FT of the echo and the FT of the rendered audio, a real-time transfer function, wherein determining the real-time transfer function comprises dividing a magnitude of the FT of the echo by the magnitude FT of the rendered audio, and wherein the real-time transfer function includes at least one signature band, and wherein the signature band comprises a signature band for a wall echo; determining a difference between the real-time transfer function and a reference transfer function; and tuning the speaker for audio rendering, based at least on the difference between the real-time transfer function and the reference transfer function, by adjusting an audio amplifier equalization.

Alternatively, or in addition to the other examples described herein, examples include any combination of the following:

capturing the echo comprises capturing the echo during a first time interval within a second time interval, the second time interval is longer than the first time interval; and repeating the capturing at completion of each second interval while the audio rendering is ongoing;

the instructions are further operative to align the echo with a copy of the rendered audio;

aligning the echo with a copy of the rendered audio;

the FT comprises an FFT;

determining whether a portion, above a threshold, of captured audio comprises an echo of the rendered audio;

determining the real-time transfer function comprises dividing a magnitude of the FT of the echo by the magnitude FT of the rendered audio;

the signature band comprises a signature band for a wall echo;

the signature band comprises a signature band for a mount echo;

the instructions are further operative to determine whether the difference between the real-time transfer function and the reference transfer function, within a first band, exceeds a threshold; and tuning the speaker for audio rendering comprises tuning the speaker for audio rendering within the first band, based at least on the difference between the real-time transfer function and the reference transfer function exceeding the threshold;

determining whether the difference between the real-time transfer function and the reference transfer function, within a first band, exceeds a threshold; and tuning the speaker for audio rendering comprises tuning the speaker for audio rendering within the first band, based at least on the difference between the real-time transfer function and the reference transfer function exceeding the threshold;

the instructions are further operative to determine whether the difference between the real-time transfer function and the reference transfer function, within a second band different from the first band, exceeds a threshold; and tuning the speaker for audio rendering comprises tuning the speaker for audio rendering within the second band, based at least on the difference between the real-time transfer function and the reference transfer function exceeding the threshold; and determining whether the difference between the real-time transfer function and the reference transfer function, within a second band different from the first band, exceeds a threshold; and tuning the speaker for audio rendering comprises tuning the speaker for audio rendering within the second band, based at least on the difference between the real-time transfer function and the reference transfer function exceeding the threshold.

While the aspects of the disclosure have been described in terms of various examples with their associated operations, a person skilled in the art would appreciate that a combination of operations from any number of different examples is also within scope of the aspects of the disclosure.

Example Operating Environment

Figure 18:
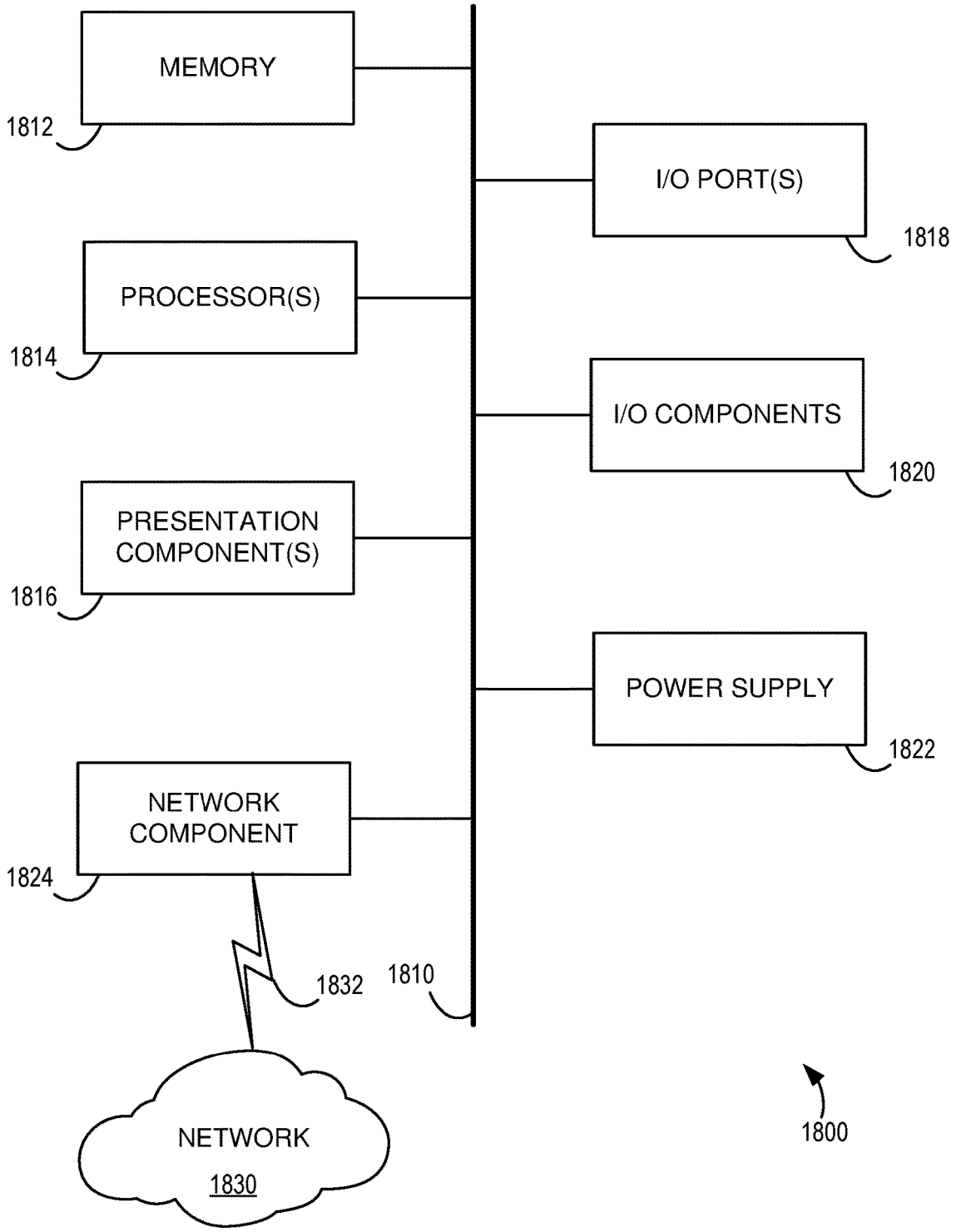
FIG. 18 is a block diagram of an example computing environment suitable for implementing some of the various examples disclosed herein.

FIG. 18 is a block diagram of an example computing device 1800 for implementing aspects disclosed herein, and is designated generally as computing device 1800. Computing device 1800 is but one example of a suitable computing environment and is not intended to suggest any limitation as to the scope of use or functionality of the examples disclosed herein. Neither should the computing device 1800 be interpreted as having any dependency or requirement relating to any one or combination of components/modules illustrated. The examples disclosed herein may be described in the general context of computer code or machine-useable instructions, including computer-executable instructions such as program components, being executed by a computer or other machine, such as a personal data assistant or other handheld device. Generally, program components including routines, programs, objects, components, data structures, and the like, refer to code that performs particular tasks, or implement particular abstract data types. The discloses examples may be practiced in a variety of system configurations, including personal computers, laptops, smart phones, mobile tablets, hand-held devices, consumer electronics, specialty computing devices, etc. The disclosed examples may also be practiced in distributed computing environments when tasks are performed by remote-processing devices that are linked through a communications network.

Computing device 1800 includes a bus 1810 that directly or indirectly couples the following devices: computer-storage memory 1812, one or more processors 1814, one or more presentation components 1816, input/output (I/O) ports 1818, I/O components 1820, a power supply 1822, and a network component 1824. While computer device 1800 is depicted as a seemingly single device, multiple computing devices 1800 may work together and share the depicted device resources. For example, memory 1812 may be distributed across multiple devices, processor(s) 1814 may provide housed on different devices, and so on.

Bus 1810 represents what may be one or more busses (such as an address bus, data bus, or a combination thereof). Although the various blocks of FIG. 18 are shown with lines for the sake of clarity, in reality, delineating various components is not so clear, and metaphorically, the lines would more accurately be grey and fuzzy. For example, one may consider a presentation component such as a display device to be an I/O component. Also, processors have memory. Such is the nature of the art, and reiterate that the diagram of FIG. 18 is merely illustrative of an exemplary computing device that can be used in connection with one or more disclosed examples. Distinction is not made between such categories as "workstation," "server," "laptop," "hand-held device," etc., as all are contemplated within the scope of FIG. 18 and the references herein to a "computing device." Memory 1812 may take the form of the computer-storage media references below and operatively provide storage of computer-readable instructions, data structures, program modules and other data for the computing device 1800. In some examples, memory 1812 stores one or more of an operating system, a universal application platform, or other program modules and program data. Memory 1812 is thus able to store and access instructions configured to carry out the various operations disclosed herein.

In some examples, memory 1812 includes computer-storage media in the form of volatile and/or nonvolatile memory, removable or non-removable memory, data disks in virtual environments, or a combination thereof. Memory 1812 may include any quantity of memory associated with or accessible by the computing device 1800. Memory 1812 may be internal to the computing device 1800 (as shown in FIG. 18), external to the computing device 1800 (not shown), or both (not shown). Examples of memory 1812 in include, without limitation, random access memory (RAM); read only memory (ROM); electronically erasable programmable read only memory (EEPROM); flash memory or other memory technologies; CD-ROM, digital versatile disks (DVDs) or other optical or holographic media; magnetic cassettes, magnetic tape, magnetic disk storage or other magnetic storage devices; memory wired into an analog computing device; or any other medium for encoding desired information and for access by the computing device 1800. Additionally, or alternatively, the memory 1812 may be distributed across multiple computing devices 1800, for example, in a virtualized environment in which instruction processing is carried out on multiple devices 1800. For the purposes of this disclosure, "computer storage media," "computer-storage memory," "memory," and "memory devices" are synonymous terms for the computer-storage memory 1812, and none of these terms include carrier waves or propagating signaling.

Processor(s) 1814 may include any quantity of processing units that read data from various entities, such as memory 1812 or I/O components 1820. Specifically, processor(s) 1814 are programmed to execute computer-executable instructions for implementing aspects of the disclosure. The instructions may be performed by the processor, by multiple processors within the computing device 1800, or by a processor external to the client computing device 1800. In some examples, the processor(s) 1814 are programmed to execute instructions such as those illustrated in the flow charts discussed below and depicted in the accompanying drawings. Moreover, in some examples, the processor(s) 1814 represent an implementation of analog techniques to perform the operations described herein. For example, the operations may be performed by an analog client computing device 1800 and/or a digital client computing device 1800. Presentation component(s) 1816 present data indications to a user or other device. Exemplary presentation components include a display device, speaker, printing component, vibrating component, etc. One skilled in the art will understand and appreciate that computer data may be presented in a number of ways, such as visually in a graphical user interface (GUI), audibly through speakers, wirelessly between computing devices 1800, across a wired connection, or in other ways. I/O ports 1818 allow computing device 1800 to be logically coupled to other devices including I/O components 1820, some of which may be built in. Examples I/O components 1820 include, for example but without limitation, a microphone, joystick, game pad, satellite dish, scanner, printer, wireless device, etc.

The computing device 1800 may operate in a networked environment via the network component 1824 using logical connections to one or more remote computers. In some examples, the network component 1824 includes a network interface card and/or computer-executable instructions (e.g., a driver) for operating the network interface card. Communication between the computing device 1800 and other devices may occur using any protocol or mechanism over any wired or wireless connection. In some examples, the network component 1824 is operable to communicate data over public, private, or hybrid (public and private) using a transfer protocol, between devices wirelessly using short range communication technologies (e.g., near-field communication (NFC), Bluetooth™ branded communications, or the like), or a combination thereof. For example, network component 1824 communicates over communication link 1832 with network 1830.

Although described in connection with an example computing device 1800, examples of the disclosure are capable of implementation with numerous other general-purpose or special-purpose computing system environments, configurations, or devices. Examples of well-known computing systems, environments, and/or configurations that may be suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, set top boxes, programmable consumer electronics, mobile telephones, mobile computing and/or communication devices in wearable or accessory form factors (e.g., watches, glasses, headsets, or earphones), network PCs, minicomputers, mainframe computers, distributed computing environments that include any of the above systems or devices, VR devices, holographic device, and the like. Such systems or devices may accept input from the user in any way, including from input devices such as a keyboard or pointing device, via gesture input, proximity input (such as by hovering), and/or via voice input.

Examples of the disclosure may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the disclosure may be implemented with any number and organization of such components or modules. For example, aspects of the disclosure are not limited to the specific computer-executable instructions or the specific components or modules illustrated in the figures and described herein. Other examples of the disclosure may include different computer-executable instructions or components having more or less functionality than illustrated and described herein. In examples involving a general-purpose computer, aspects of the disclosure transform the general-purpose computer into a special-purpose computing device when configured to execute the instructions described herein.

By way of example and not limitation, computer readable media comprise computer storage media and communication media. Computer storage media include volatile and nonvolatile, removable and non-removable memory implemented in any method or technology for storage of information such as computer readable instructions, data structures, program modules, or the like. Computer storage media are tangible and mutually exclusive to communication media. Computer storage media are implemented in hardware and exclude carrier waves and propagated signals. Computer storage media for purposes of this disclosure are not signals per se. Exemplary computer storage media include hard disks, flash drives, solid-state memory, phase change random-access memory (PRAM), static random-access memory (SRAM), dynamic random-access memory (DRAM), other types of random-access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium that can be used to store information for access by a computing device. In contrast, communication media typically embody computer readable instructions, data structures, program modules, or the like in a modulated data signal such as a carrier wave or other transport mechanism and include any information delivery media.

The order of execution or performance of the operations in examples of the disclosure illustrated and described herein is not essential, and may be performed in different sequential manners in various examples. For example, it is contemplated that executing or performing a particular operation before, contemporaneously with, or after another operation is within the scope of aspects of the disclosure. When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A system for dynamic device speaker tuning for echo control, the system comprising:
- a speaker located on a device;
- a processor; and
- a computer-readable medium storing instructions that are operative when executed by the processor to:
  - generate a spectral mask, the spectral mask including at least one signature band;
  - determine, based at least on an echo of rendered audio, a real-time transfer function, wherein the real-time transfer function includes the at least one signature band;
  - apply the spectral mask to the real-time transfer function and a reference transfer function;
  - determine a difference between the real-time transfer function and the reference transfer function;
  - tune a speaker for audio rendering, based at least on the difference between the real-time transfer function and the reference transfer function, by adjusting an audio amplifier equalization.

2. The system of claim 1, wherein the instructions are further operative to:
- determine whether a portion, above a threshold, of captured audio comprises the echo of the rendered audio.

3. The system of claim 1, wherein the instructions are further operative to:
- capture the echo of the rendered audio.

4. The system of claim 1, wherein the instructions are further operative to:
- align the echo with a copy of the rendered audio and window the echo with the copy of the rendered audio.

5. The system of claim 1, wherein the signature band comprises a signature band for a mount echo.

6. The system of claim 1, wherein the instructions are further operative to:
- determine whether the difference between the real-time transfer function and the reference transfer function, within a band, exceeds a threshold; and
- wherein tuning the speaker for audio rendering comprises:
  - tuning the speaker for audio rendering within the band, based at least on the difference between the real-time transfer function and the reference transfer function exceeding the threshold.

7. The system of claim 1, wherein determining the real-time transfer function comprises dividing a magnitude of the FT of the echo by a magnitude of the FT of the rendered audio.

8. The system of claim 1, wherein the instructions are further operative to:

render audio data as an audio stream over the speaker, using the audio amplifier, to generate the rendered audio.

9. A method of dynamic device speaker tuning for echo control, the method comprising:

generating a spectral mask, the spectral mask including at least one signature band;

determining, based at least on an echo of rendered audio, a real-time transfer function, wherein the real-time transfer function includes the at least one signature band;

applying the spectral mask to the real-time transfer function and a reference transfer function;

determining a difference between the real-time transfer function and the reference transfer function;

tuning a speaker for audio rendering, based at least on the difference between the real-time transfer function and the reference transfer function, by adjusting an audio amplifier equalization.

10. The method of claim 9, further comprising:

determining whether a portion, above a threshold, of captured audio comprises the echo of the rendered audio.

11. The method of claim 9, further comprising:

capturing the echo of the rendered audio.

12. The method of claim 9, further comprising:

aligning the echo with a copy of the rendered audio and windowing the echo with the copy of the rendered audio.

13. The method of claim 9, wherein the signature band comprises a signature band for a mount echo.

14. The method of claim 9, further comprising:

determining whether the difference between the real-time transfer function and the reference transfer function, within a band, exceeds a threshold; and wherein tuning the speaker for audio rendering comprises:

tuning the speaker for audio rendering within the band, based at least on the difference between the real-time transfer function and the reference transfer function exceeding the threshold.

15. The method of claim 9, wherein determining the real-time transfer function comprises dividing a magnitude of the FT of the echo by a magnitude of the FT of the rendered audio.

16. One or more computer storage devices having computer-executable instructions stored thereon for dynamic device speaker tuning for echo control, which, on execution by a computer, cause the computer to perform operations comprising:

generating a spectral mask, the spectral mask including at least one signature band;

determining, based at least on an echo of rendered audio, a real-time transfer function, wherein the real-time transfer function includes the at least one signature band;

applying the spectral mask to the real-time transfer function and a reference transfer function;

determining a difference between the real-time transfer function and the reference transfer function;

tuning a speaker for audio rendering, based at least on the difference between the real-time transfer function and the reference transfer function, by adjusting an audio amplifier equalization.

17. The one or more computer storage devices of claim 16, wherein the operations further comprise:

determining whether a portion, above a threshold, of captured audio comprises the echo of the rendered audio.

18. The one or more computer storage devices of claim 16, wherein the operations further comprise:

capturing the echo of the rendered audio.

19. The one or more computer storage devices of claim 16, wherein the signature band comprises a signature band for a mount echo.

20. The one or more computer storage devices of claim 16, wherein the operations further comprise:

determining whether the difference between the real-time transfer function and the reference transfer function, within a band, exceeds a threshold; and wherein tuning the speaker for audio rendering comprises:

tuning the speaker for audio rendering within the band, based at least on the difference between the real-time transfer function and the reference transfer function exceeding the threshold.

* * * * *